US007051555B2

(12) United States Patent
Okamoto

(10) Patent No.: US 7,051,555 B2
(45) Date of Patent: May 30, 2006

(54) METHOD OF KNITTING KNIT-WEAR

(75) Inventor: Kazuyoshi Okamoto, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 70 days.

(21) Appl. No.: 10/515,504

(22) PCT Filed: May 14, 2003

(86) PCT No.: PCT/JP03/06038

§ 371 (c)(1),
(2), (4) Date: Nov. 24, 2004

(87) PCT Pub. No.: WO03/100146

PCT Pub. Date: Dec. 4, 2003

(65) Prior Publication Data

US 2005/0183464 A1 Aug. 25, 2005

(30) Foreign Application Priority Data

May 27, 2002 (JP) ..... 2002-152688

(51) Int. Cl.
*D04B 7/10* (2006.01)

(52) U.S. Cl. ..... 66/70; 66/176

(58) Field of Classification Search ..... 66/64, 66/60 R, 62, 69, 75.1, 170–175, 201, 172 R
See application file for complete search history.

(56) References Cited

U.S. PATENT DOCUMENTS 5,388,430 A * 2/1995 Essig ..... 66/64
5,584,197 A * 12/1996 Okuno ..... 66/64
5,669,244 A * 9/1997 Okuno ..... 66/64
5,826,445 A * 10/1998 Okamoto ..... 66/70
6,192,716 B1 * 2/2001 Essig et al. ..... 66/60 R

FOREIGN PATENT DOCUMENTS

| | | |
|---|---|---|
| JP | 3-75656 | 12/1991 |
| WO | 01/55491 | 8/2001 |
| WO | 01/63030 | 8/2001 |
| WO | 02/070800 | 9/2002 |
| WO | 02/092895 | 11/2002 |

* cited by examiner

*Primary Examiner*—Danny Worrell
(74) *Attorney, Agent, or Firm*—Wenderoth, Lind & Ponack, L.L.P.

(57) ABSTRACT

A method for seamlessly knitting knitwear having a broad neckline with a flat knitting machine includes forming a neckline by a first step in which a breast is knitted by branching off into right and left breasts from its front neckline forming portion. All knitted loops, excluding those of either the right or left breast to be knitted and including those of a front neckline, are transferred to the other empty needles, and knitting for forming increases of the front neckline at the other empty needles is performed while racking the needle bed. In a second step, one of the ends of a back and the end (close to an armhole) of either the right or left breast knitted by the first step are facing each other, and these ends are joined together by shoulder casting off. In a third step, the end of the back which is not subjected to shoulder casting off and the end (close to the armhole) of the breast which is not subjected to shoulder casting off are arranged to face each other and are joined together by shoulder casting off.

2 Claims, 8 Drawing Sheets

METHOD OF KNITTING KNIT-WEAR

TECHNICAL FIELD

The present invention relates to a knitting method for knitwear to be formed by joining knitting fabric without sewing, which is seamlessly and cylindrically knitted. In particularly, the present invention relates to a knitting method for forming a broad neckline of knitwear such as a sweater or a cardigan and other knitting methods like that.

BACKGROUND ART

As explicitly stated in International Publication No. WO 01/55491 and as shown in FIGS. 7 and 8, the inventor of the present invention has proposed a knitting method for non-sewing knitwear, with which a front neckline 310 being broad in a forwardly hanging manner is formed on a breast 100*a* by using a flat knitting machine. The machine has at least a pair of front and back needle beds extending to the right and left direction and facing each other in the front and back direction, with at least one of the front and back needle beds being capable of sideways racking and capable of loop transfer of knitted loops between the front and back needle beds.

This proposal is basically such that, after a torso 100 (10*a*, 100*b*) and both sleeves 210(210*a*, 21*b*) and 220(220*a*, 220*b*) are cylindrically knitted from the hem to the armpits of knitwear and, when the breast 100*a* is knitted, the front neckline 310 is formed on the breast 100*a* by knitting the breast 100*a* such that the breast 100*a* is branched off into right and left breasts 110*a* and 120*a* so as to sandwich the neckline 300 from the start line of forming the neckline 300 (the dotted line L1 shown in FIG. 8).

Then, in order to broadly form the neckline, during the process of knitting the right and left breasts 110*a* and 120*a* (from the dotted line L2 shown in FIG. 8), by repeating an operation of returning all knitted loops of the back to the original needle bed after all knitted loops of the right or left breast 11*a* or 120*a* are transferred to the needle bed having knitted loops of the back retained thereat and racking of the transferred needle bed is performed so as to achieve knitting for gradually moving knitted loops of the right or left breast 110*a* or 120*a* outward with respect to the center of the torso, increases of the front neckline 310 are formed along the periphery 300.

Further, the knitted loops of the front neckline 310 are further increased by using several knitted loops of the final course of each of the right and left breasts 110*a* and 120*a* from its end close to the neckline to point L3 shown in FIG. 8 for knitting the neckline.

By forming the front neckline 310 as described above, the number of wales of the front neckline 310 is increased. As a result, not only a collar 400 which is sequentially knitted has a neckline with a large bore, but also the neckline 300 is spontaneously formed in a forwardly hanging state.

When a sweater is produced by using the breast 100*a* knitted so as to have the broad neckline 300 as described above, the sweater is highly fashionable and comfortable to wear since a wearer can easily get his or her head through the collar during wearing and is not tightened by the collar.

However, with the above described knitting method, in order to form increases at the neckline, all knitted loops of the right or left breast 110*a* or 120*a* are transferred to the needle bed having the knitted loops of the back retained thereat, and after causing the transferred needle bed to perform a racking action, by repeating the action of returning all knitted loops of the breast to the original needle bed, knitting is performed so as to gradually move the knitted loops of the right or left breast 110*a* or 120*a* outward with respect to the center of the torso, whereby the loop transfer actions are performed twice as much as the number of the increases with respect to the same knitted loop when the knitted loops of the breast are transferred.

When the transferring actions are performed many times with respect to the same knitted loop as described above, there arises a problem that yawn is likely damaged.

Also, with the foregoing method for knitting a neckline, although several knitted loops are formed from the side end of the neckline of the final course of each of the right and left breasts 11*a* and 120*a* to point L3 shown in FIG. 8, since a part of the final course of each of the right and left breasts 110*a* and 120*a* is used for knitting the neckline, the shoulder joining portion is shorter by that much and a back neckline 320 of the back 100*b* is transversely longer.

When the back neckline 320 of the back 100*b* is excessively longer, the entire neckline does not have a forwardly hanging shape but falls in a state of extending transversely, thereby causing a problem of being unattractive and unfashionable.

SUMMARY OF THE INVENTION

The present invention has been developed in view of the above-described present state. Accordingly, it is an object of the present invention to provide a knitting method for knitwear, which can reduce a load on yawn during knitting and form a fashionable and broad neckline in a forwardly hanging manner.

In order to achieve the above object, according to the present invention, a knitting method for knitwear in which a torso making up the knitwear is knitted so as to be a seamless and continuous cylinder by using a flat knitting machine having at least a pair of front and back needle beds extending to the left and right directions and facing each other in the front and back directions, with at least one of the front and back needle beds being capable of sideways racking, and capable of loop transfer of knitted loops between the front and back needle beds is provided. The knitting method is characterized by including the following steps for knitting, when the torso is knitted from the armpits to the shoulder after the torso is knitted from the hem to the armpits and when a breast is knitted by branching off the breast into right and left breasts from its front neckline forming portion so as to form a neckline on the torso.

1) A first step includes:

a process in which all knitted loops excluding those of either the right or left breast are transferred to the needle bed having knitted loops of a back retained thereat; racking of the needle bed is performed in the direction in which one of the breasts of the needle bed having the knitted loops of the back retained thereat moves away from the other breast retained at the other needle bed by the number of pitches in proportion to the number of increases (i.e., the number of knitted loops to be increased). After the breast retained at the other needle bed is knitted for a predetermined number of courses while increases of the front neckline of the needle bed having the knitted loops of the back retained thereat are formed at its end close to the breast retained at the other needle bed so as to correspond to the number of pitches of racking, the knitted loops transferred to the needle bed having the knitted loops of the back retained thereat are transferred to the original needle bed.

The first step also includes a process in which all knitted loops excluding those of the breast which are not subjected to knitting for these predetermined number of courses are transferred to the needle bed having the knitted loops of the back retained thereat. Racking of the needle bed is performed in the direction where the breast of the needle bed having the knitted loops of the back retained thereat moves away from the breast retained at the other needle bed by the number of pitches in proportion of the number of increases. After the breast retained at the other needle bed is knitted for the predetermined number of courses while increases of the front neckline of the needle bed having the knitted loops of the back retained thereat are formed at its end close to the breast retained at the other needle bed so as to correspond to the number of pitches of racking, the knitted loops transferred to the needle bed having the knitted loops of the back retained thereat are transferred to the original needle bed.

The first step further includes a process in which the back is knitted for the predetermined courses;

2) A second step includes, after or halfway through the first step, one of the ends of the back knitted in the first step and the end, close to an armhole, of either the right or left breast knitted in the first step are brought into a state of facing each other by a passing operation of knitted loops, the operation composed of a racking operation of the needle and loop transfer to the front and back needle beds, the back and either the right or left breast are joined together by shoulder casting off.

3) A third step includes, after the first and second steps, the end of the back which is not subjected to shoulder casting off, and the end, close to the armhole, of either the left or right breast which is not subjected to shoulder casting off are brought into a state of facing each other by the passing operation of the knitted loops, the operation composed of a racking operation of the needle bed and loop transfer to the front and back needle beds, and the back and either the left and right breast are joined together by shoulder casting off.

Also, according to the present invention, in the above-described knitting method for knitwear, the first step includes a first neckline increase step in which increases of the front neckline are processed while the right and left breasts are knitted for the predetermined courses, each with the same number of knitted loops, and the back is knitted for the predetermined courses.

A second neckline increase step includes, following the knitting of the breast and the back by the first neckline increase step, increases of the front neckline are processed while knitting the right and left breasts for the predetermined courses with their ends close to the armholes being processed by partial knitting, and the back is knitted for the predetermined courses.

Knitting in the second and third steps is performed after one of the breasts is knitted by the second neckline increase step.

Knitwear to be knitted is preferably a set-in type sweater.

DETAILED DESCRIPTION OF THE INVENTION

Embodiments of knitting methods for knitwear according to the present invention will be described with reference to the drawings.

According to the present embodiments, knitwear is knitted with a so-called double-bed flat knitting machine which extends to the right and left direction and has a pair of front and back needle beds facing each other in the front and back direction. The back needle bed is capable of sideways racking, and the front and back needle beds are capable of transferring knitted loops therebetween.

When knitting cylindrical knitwear, the double-bed flat knitting machine is designed to knit it by using every other needle of each of the front and back needle beds. For example, the odd-numbered needles of the front needle bed are mainly used for knitting a piece of knitting fabric of the front portion of the knitwear such as a breast or the front potion of a sleeve, and the even-numbered needles of the back needle bed are mainly used for knitting the back portion of the knitwear such as the back or the back portion of the sleeve. In addition, the front and back needle beds are designed such that the needles of the other needle bed opposing those of one needle bed used for knitting are designated as empty needles and these empty needles are used for loop transfer, rib knitting, or the like.

With these empty needles, a constitution pattern mixed with face stitches and back stitches of a link, a suspender, a rib or the like is knitted, or knitted loops of the sleeve and the torso are moved in the course direction and jointed together.

Also, when the double-bed flat knitting machine is used, knitting fabric may be knitted by disposing a transfer jack bed with a number of transfer jacks above one or both of the front and back needle beds.

Meanwhile, according to the present embodiments, although the knitwear is knitted with a double-bed flat knitting machine, the present invention allows the knitwear to be knitted with a quadruple-bed flat knitting machine composed of upper and lower front needle beds, and upper and lower back needle beds.

When the quadruple-bed flat knitting machine is used, for example, the front and back portions of the knitwear are respectively attached to the lower front and back needle beds. In addition, the upper front and back needle beds are used as empty needles for, for example, loop transfer of the knitting fabric of the front and back portions in order to knit the knitting fabric of the front and back portions, respectively.

The present embodiments provide knitting methods for knitwear with a torso and sleeves making up the knitwear so as to be seamless and continuous cylinders by using the foregoing two-bed flat knitting machine.

Figure 1:
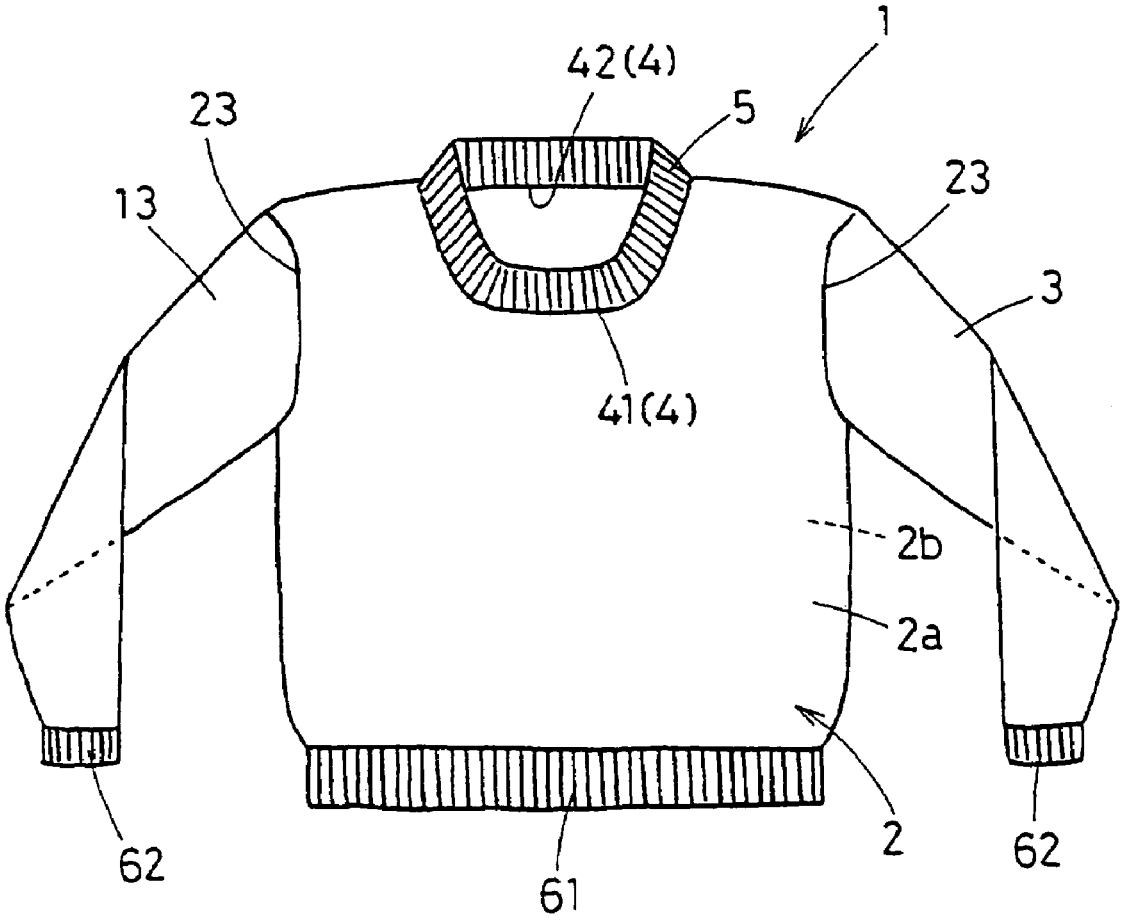
FIG. 1 illustrates a round-necked set-in sweater as a first embodiment of knitwear according to the present invention.
Figure 2:
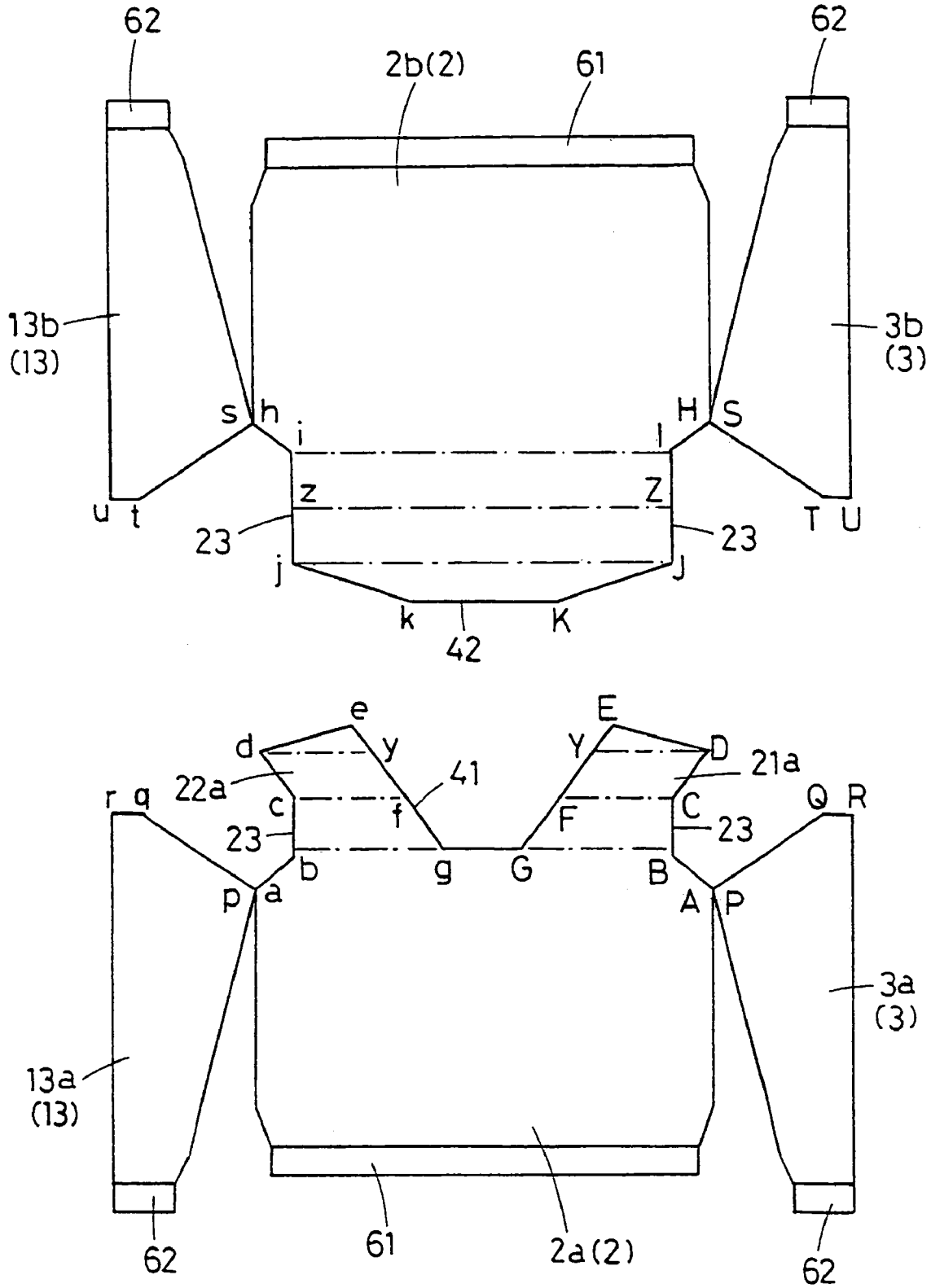
FIG. 2 illustrates a state in which all parts making up the sweater as the first embodiment are knitted by a flat knitting machine.

A first embodiment of the present invention will be described with reference to FIGS. 1 to 5. FIG. 1 illustrates a set-in sweater 1 as knitwear knitted by a knitting method according to the present invention. FIG. 2 illustrates a paper pattern (stitch arrangement) of a torso and sleeves making up the sweater 1, in which a back 2*b* and right- and left-sleeve back portions 13*b* and 3*b* of both sleeves appearing at the back of the sweater when it is worn are shown in the upper part of the figure and a breast 2*a* and right- and left-sleeve front portion 13*a* and 3*a* of both sleeves appearing at the front of the sweater when it is worn are shown in the lower part of the figure.

The back 2*b* and the left- and right-sleeve back portions 3*b* and 13*b* are mainly knitted by odd-numbered needles on a back needle bed BB, and the breast 2*a* and the left- and right-sleeve front portions 3*a* and 13*a* are mainly knitted by even-numbered needles on a front needle bed FB.

The sweater 1 knitted according to the present embodiment is a round-necked type and is designed such that the breast 2*a* and the back 2*b* are joined together on the shoulder line by bringing the lengths (the number of courses) of the breast 2*a* and the back 2*b* from the hems to the joining portions with the sleeves at the shoulder into agreement with each other.

Although the knitting weave of the torso and the sleeves of the sweater 1 are plain knitted and plain colored for the sake of explanation, it may have a constitution pattern such as jacquard or rib.

As shown in FIG. 2, in the sweater 1, points A and a of the breast 2*a* indicating armpits are joined with the corresponding points P and p of the left- and right-sleeve front portions 3*a* and 13*a*, and points H and h of the back 2*b* are joined with the corresponding points S and s of the left- and right-sleeve back portions 3*b* and 13*b*.

Then, the breast 2*a* and the left- and right-sleeve front portions 3*a* and 13*a* are joined together along armholes 23, and the back 2*b* and the left- and right-sleeve back portions 3*b* and 13*b* are joined together along the same.

The breast 2*a* has a different shape from the back 2*b* and, as shown in FIG. 2, is knitted while being branched off into left and right breasts 21*a* and 22*a* from points G and g from which a neckline 4 starts to be formed.

Further, after the start of forming the neckline 4, the knitting of the torsos 2*a* and 2*b* and the sleeves 3 and 13 is performed such that, while knitting the left breast 21*a*, the left-sleeve front portion 3*a*, the left-sleeve back portion 3*b*, the back 2*b*, the right-sleeve back portion 13*b*, the right sleeve front portion 13*a*, the right breast 22*a* in that order or in the reverse order to that, the left-sleeve front portion 3*a* is joined with the left breast 21*a*, the left- and right-sleeve back portions 3*b* and 13*b* are joined with the back 2*b*, and the right sleeve front portion 13*a* is joined with the right breast 22*a*, all along the armholes 23.

The breast 2*a* and the back 2*b* are joined together at the shoulder portion after the left and right sleeves 3 and 13 are joined together.

Then, a collar 5 is knitted by rib knitting along a circle formed by line e-y-f-g-G-F-Y-E-K-k-e.

Meanwhile, in the present embodiment, terms indicating left and right of a torso and sleeves (for example, left and right of the left and right breasts 21*a* and 22*a*) and the like are described with reference to a wearer wearing the sweater 1.

Figure 3:
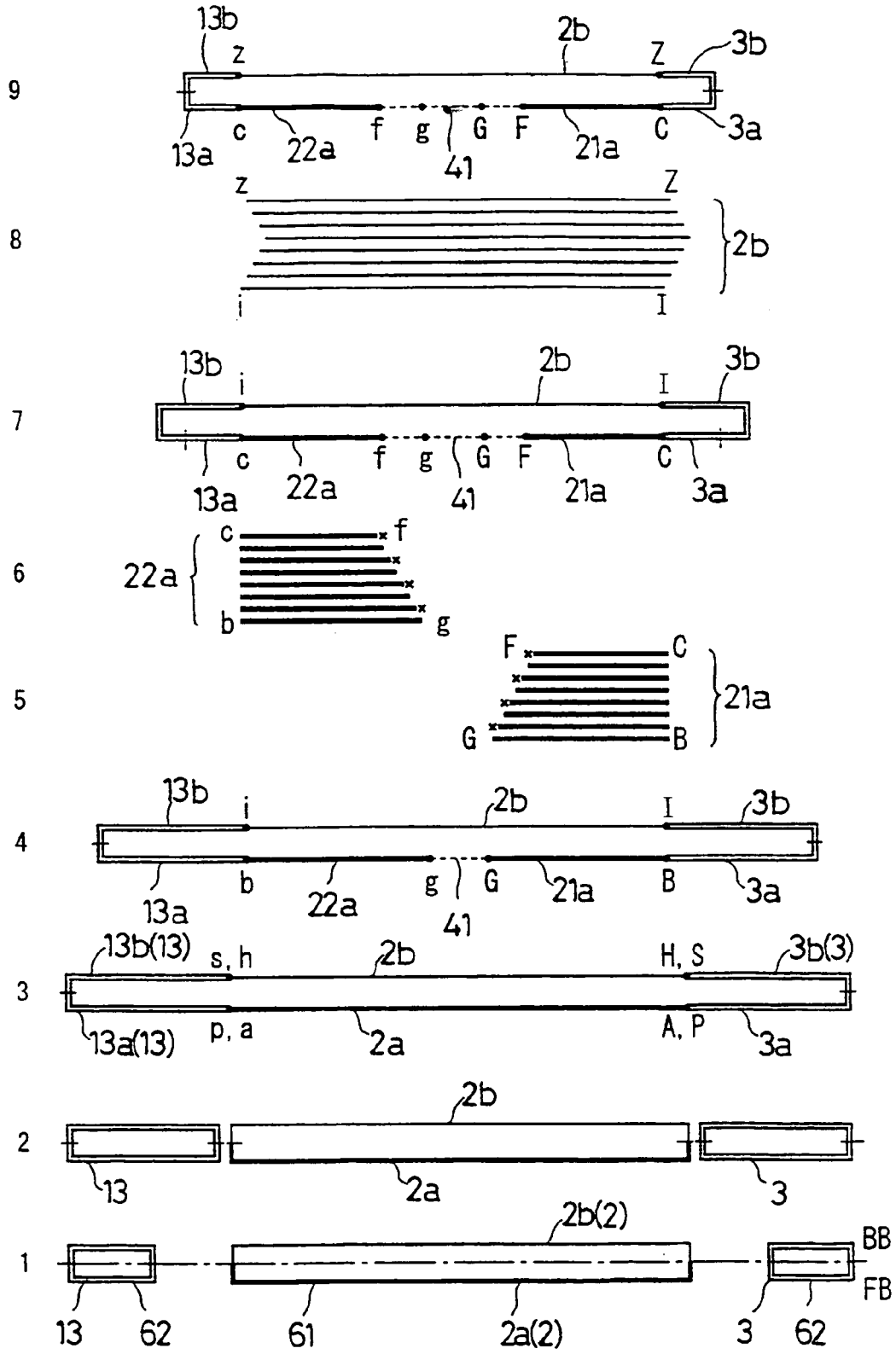
FIG. 3 illustrates Steps 1 to 9 of the knitting steps of the sweater as the first embodiment.
Figure 4:
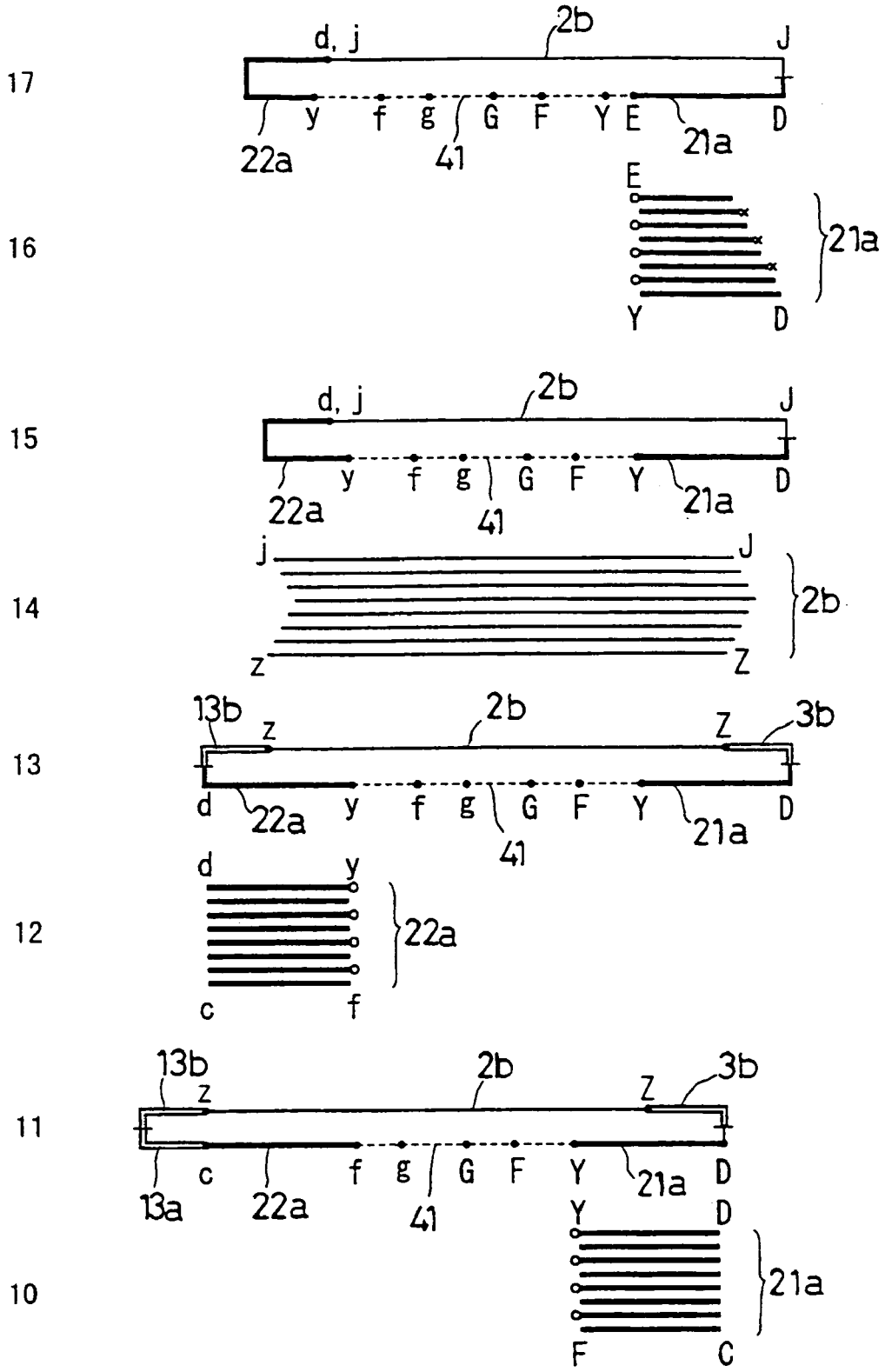
FIG. 4 illustrates Steps 10 to 17 of the knitting steps of the sweater as the first embodiment.
Figure 5:
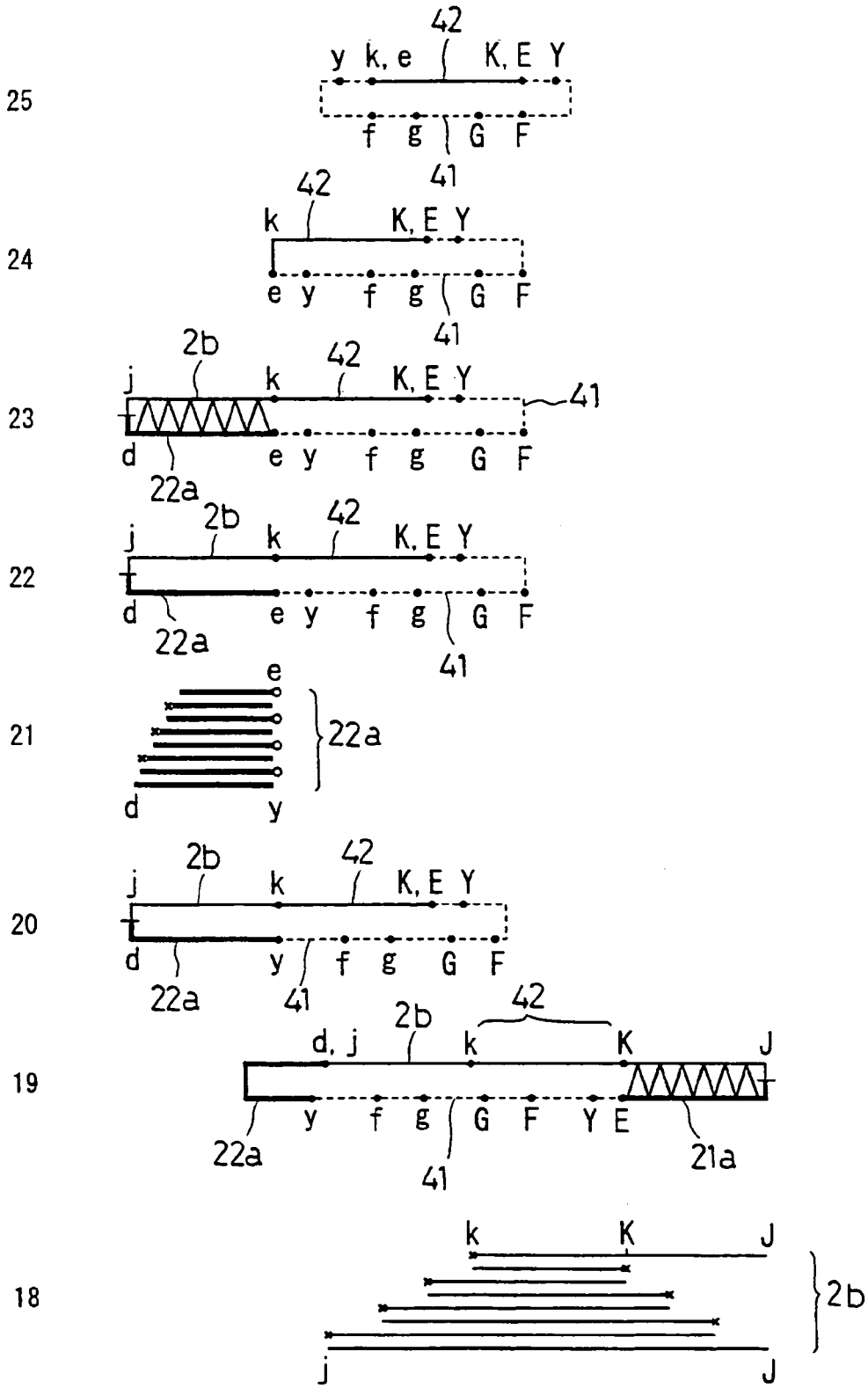
FIG. 5 illustrates Steps 18 to 25 of the knitting steps of the sweater as the first embodiment.

FIGS. 3 to 5 illustrate a knitting step diagram showing detailed knitting at each step when the sweater 1 is knitted from the hem toward the shoulder (the steps being indicated by the numbers along the left side of the figures).

In the knitting step diagram, the breast 2*a*, the back 2*b*, the sleeves 3 and 13, and a front neckline 41 of the breast 2*a* are respectively depicted with a bold line, a thin solid line, a double line, and a dotted line.

Step 1 is a process in which, by repeating knitting in which, after feeding knitting yarns from feeding ports (not shown) respectively prepared for knitting the torso and the sleeves to every needle of the front needle bed FB, the feeding ports are inverted so as to feed the knitting yarns to every needle of the back needle bed BB, knitting of rubber knitting portions 61 and 62 to the hem of the cylindrical torso and the cuffs of the cylindrical right and left sleeves starts.

Step 2 is a process in which, in conjunction with knitting of a torso 2, knitting of the left and right sleeves 3 and 13 is performed while magnifying their cylinder bores, and the knitting is finished short of the armpit portions (shown by points A, P, a, p, S, H, s, and h in FIG. 2).

Step 3 is a process in which the torso 2 and the left and right sleeves 3 and 13 are integrated into a single cylindrical body at the armpit portions. In this state, knitting is performed, for example, by feeding the knitting yarns used for knitting the torso through the feeding ports.

Step 4 is a process in which every piece of knitting fabric is retained at the needle beds when the knitting of the breast 2*a* reaches the positions G and g at which formation of the neckline 4 starts. The breast 2*a* is branched off into the left and right breasts 21*a* and 22*a* from these points.

Meanwhile, from Step 3 to Step 4, by repeating knitting in which, while knitting the left and right sleeves 3 and 13, for example, with the ratio 3:1 of the numbers of course knitting of the torso portion and the sleeve portions of the cylindrical body formed by the torso 2 and the sleeves 3 and 13, knitting yarns are superposed by moving both sleeves 3 and 13 toward the torso 2, the bore diameter of the cylindrical body formed by the torso 2 and the sleeves 3 and 13 is gradually reduced. At the same time, the knitted width of the torso 2 is reduced.

Step 5 is a process in which the left breast 21*a* is knitted from line B-G to line C-F shown in FIG. 2. In Step 5, by tucking the end of the left breast 21*a* close to the neckline by every other course, partial knitting which sequentially brings the knitted loops along the periphery of the neckline 4 along line G-F in an inoperative state is performed, and the left-sleeve front portion 3*a* and the left breast 21*a* are joined together at the same time.

In Step 5, all knitted loops of the left-sleeve front portion 3*a* are transferred to the empty needles of the back needle bed BB having the knitted loops of the back 2*b* retained thereat.

The left breast 21*a* is knitted from its side close to the armhole by one course, and the following one course is knitted while tucking the knitted loop of the end of the breast 21*a* close to the neckline to the needle having the knitted loop of the neckline retained thereat (the needle having knitted loop G retained thereat).

Then, racking of the back needle bed BB is performed by two pitches leftward in FIG. 3, and the knitted loop of the end of the left-sleeve front portion 3*a* close to the breast is transferred to that of the end of the left breast 21*a* close to the sleeve and is superposed with the same.

By repeating a series of these operations for the predetermined courses until reaching line F-C, the left-sleeve front portion 3*a* and the left breast 21*a* are joined together while forming the front neckline 41. When the knitting is finished up to line F-C, the knitted loops of the left-sleeve front portion 3*a* retained at the back needle bed BB are returned to the front needle bed FB.

Step 6 is a process in which the right breast 22*a* is knitted from line b-g to line c-f shown in FIG. 2. Also in Step 6, by tucking the end of the right breast 22*a* close to the neckline by every other course, partial knitting which sequentially brings the knitted loops along the periphery of the neckline 4 in an inoperative state along line g-f is performed, and also the right sleeve front portion 13*a* and the right breast 22*a* are joined together.

In Step 6, all knitted loops of the right sleeve front and back portions 13*a* and 13*b* retained at the front needle bed FB are transferred to the empty needles of the back needle bed BB having the knitted loops of the back 2*b* retained thereat.

The right breast 22*a* is knitted from the side of the armhole by one course (length), and the following course (length) is knitted while tucking the knitted loop of the end of the breast 22*a* close to the neckline to the needle having the knitted loop of the neckline retained thereat (the needle having the knitted loop g retained thereat).

Then, racking of the back needle bed BB is performed by two pitches rightward in FIG. 3, and the knitted loop of the end of the right sleeve front portion 13*a* close to the breast is transferred to that of the end of the right breast 22*a* close to the sleeve and is superposed with the same.

By repeating a series of these operations for the predetermined courses until reaching line f-c, the right sleeve front portion 13*a* and the right breast 22*a* are joined together while forming the front neckline 41. When the knitting operation is finished up to line f-c, all knitted loops of the right sleeve front and back portions 13*a* and 13*b* retained at the back needle bed BB are returned to the front needle bed FB.

With the knitting operations in Steps 5 and 6, the start portion of the front neckline 41 is formed along line F-G-g-f, thereby bringing about a state of Step 7.

Step 8 is a process in which the back 2*b* is knitted from line I-i to line Z-z while being joined with the left- and right-sleeve back portions 3*b* and 13*b*.

In Step 8, after only the back 2*b* is knitted by two courses, all knitted loops of the back 2*b* and the left-sleeve back portion 3*b*, all retained at the back needle bed BB, are transferred to the empty needles of the front needle bed FB.

Then, after racking of the back needle bed BB is performed by two pitches toward the left-sleeve back portion 3*b* (rightward in FIG. 3), all knitted loops of the back 2*b* retained at the front needle bed FB are returned to the back needle bed BB. With this operation, the knitted loops of the ends of the back 2*b* and the right-sleeve back portion 13*b* are superposed and joined together.

Subsequently, racking of the back needle bed BB is performed rightward in FIG. 3 by two additional pitches, and the knitted loop of the end, close to the torso, of the left-sleeve back portion 3*b* retained at the front needle bed FB is transferred to the back needle bed BB. With this operation, the knitted loops of the ends of the back 2*b* and the left-sleeve back portion 3*b* are superposed and joined together.

Then, in a state in which the knitted loops of the left-sleeve back portion 3*b* are retained at the front needle bed FB, the same operations as described above, composed of knitting of the back 2*b*, the racking operation of the back needle bed BB, loop transfer of the knitted loops of the back 2*b*, and loop transfer of the knitted loop of the end, close to the torso, of the left-sleeve back portion 3*b* to the back needle bed BB are repeated. By performing a series of these operations for the predetermined courses, the left-sleeve back portion 3*b* and the back 2*b* are joined together.

Also, in Step 8, subsequently, all knitted loops of the left-sleeve back portion 3*b* retained at the empty needles of the front needle bed FB are returned to the back needle bed BB, and, after only the back 2*b* is knitted by two courses, all knitted loops of the back 2*b* and the right-sleeve back portion 13*b*, all retained at the back needle bed BB, are transferred to the empty needles of the front needle bed FB.

Then, after racking of the back needle bed BB is performed by two pitches toward the right-sleeve back portion 13*b* (leftward in FIG. 3), all knitted loops of the back 2*b* retained at the front needle bed FB are returned to the back needle bed BB. With this operation, the knitted loops of the ends of the back 2*b* and the left-sleeve back portion 3*b* are superposed and joined together.

Subsequently, racking of the back needle bed BB is performed leftward in FIG. 3 by two additional pitches, and the knitted loop of the end, close to the torso, of the right-sleeve back portion 13*b* retained at the front needle bed FB is transferred to the back needle bed BB. With this operation, the knitted loops of the ends of the back 2*b* and the right-sleeve back portion 13*b* are superposed and joined together.

Then, in a state in which the knitted loops of the right-sleeve back portion 13*b* are retained at the front needle bed FB, the same operations as described above, composed of knitting of the back 2*b*, the racking operation of the back needle bed BB, loop transfer of the knitted loops of the back 2*b*, and the end, close to the torso, of the right-sleeve back portion 13*b* to the back needle bed BB are repeated. By performing a series of these operations for the predetermined number of courses, the right-sleeve back portion 13*b* and the back 2*b* are joined together. The knitting in Step 8 brings about a state of Step 9.

In Steps 10 to 15, a first neckline increase step in a process of a first step according to the present invention is performed so as to knit the front neckline 41 for increasing its knitted width from line F-G-g-f. Specifically, knitting for forming the front neckline 41 is performed from line F-Y to line f-y.

Step 10 shows a state in which course knitting of the left breast 21*a* is illustrated, and the left breast 21*a* is knitted from line C-F to line D-Y. During this course knitting, the left portion of the neckline 4 is also formed.

In Step 10, first of all, the right sleeve front portion 13*a*, the right breast 22*a*, the front neckline 41 (line F-G-g-f), and the left-sleeve front portion 3*a*, all retained at the front needle bed FB, are transferred to the empty needles of the back needle bed BB.

Then, racking of the back needle bed BB is performed by two pitches to the direction (leftward in FIGS. 3 and 4) along which the right breast 22*a* moves away from the left breast 21*a* retained at the front needle bed FB. After the racking, the left breast 21*a* is knitted by one course. After the knitted loop of the end of the left-sleeve front portion 3*a* close to the breast is transferred to that of the end of the left breast 21*a* close to the sleeve and is superposed with it, the left breast 21*a* is knitted by one course while forming a one-knitted-loop increase at empty needles next to the end of the left breast 21*a* in the knitted loops of the front neckline 41 retained at the back needle bed BB.

Further, racking of the back needle bed BB is performed by two pitches to the direction (leftward in FIGS. 3 and 4) along which the right breast 22*a* moves away from the left breast 21*a* retained at the front needle bed FB. After the racking, the left breast 21*a* is knitted by one course, and, after the knitted loop of the end of the left-sleeve front portion 3*a* close to the breast is transferred to that of the end of the left breast 21*a* close to the sleeve and is superposed with it, the left breast 21*a* is formed by one course while forming a one-knitted-loop increase at empty needles next to the end of the left breast 21*a* in the knitted loops of the front neckline 41 retained at the back needle bed BB.

As described above, when the operations of racking the back needle bed BB by the number of pitches in proportion to the number of increases (two pitches for a one-knitted-loop increase) and knitting the left breast 21*a* for the predetermined number of courses while forming increases corresponding to the number of pitches of the racking at the end, close to the left breast 21*a*, of the front neckline 41 retained at the back needle bed BB are repeated by the predetermined number of times, the left-sleeve front portion 3*a* and the left breast 21*a* can be joined together while providing the front neckline 41 with increased knitted loops.

In Step 10, the left breast 21*a* is knitted for eight courses, each with the same number of knitted loops, and also the left-sleeve front portion 3*a* is completely joined with the left breast 21*a*.

At this moment, an increase is formed at the empty needle of the back needle bed BB, close to the end of the neckline for every knitting course of the left breast 21*a*, the knitted loops of the periphery of the front neckline 41 are sequentially formed in an inoperative state along line F-Y, and the number of knitted loops of the front neckline 41 is increased by 4 (wales) during Step 10.

After the knitting of Step 10, transferring the right sleeve front portion 13*a*, the right breast 22*a*, and the front neckline 41 (line Y-F-G-g-f), all retained at the back needle bed BB, to the front needle bed FB brings about Step 11. Thus, the front neckline 41 is formed along line F-Y and also the left-sleeve front portion 3*a* is completely joined with the left breast 21*a*.

Step 12 shows a state in which course knitting of the right breast 22*a* is illustrated, and the right breast 22*a* is knitted from line c-f to line d-y. During this course knitting, the right side portion of the neckline 4 is also formed.

In Step 12, first of all, the left breast 21*a*, the front neckline 41 (line Y-F-G-g-f), and the right sleeve front portion 13*a*, all retained at the front needle bed FB, are transferred to the empty needles of the back needle bed BB.

Then, racking of the back needle bed BB is performed by two pitches to the direction (rightward in FIGS. 3 and 4) along which the left breast 21*a* moves away from the right breast 22*a* retained at the front needle bed FB. After the racking, the right breast 22*a* is knitted by one course, and, after the knitted loop of the front-end of the right sleeve front portion 13*a* close to the torso is transferred to that of the end of the right breast 22*a* close to the sleeve and is superposed with it, the right breast 22*a* is knitted by one course while forming a one-knitted-loop increase at empty needles next to the end of the right breast 22*a* in the knitted loops of the front neckline 41 retained at the back needle bed BB.

Further, racking of the back needle bed BB is performed by two pitches to the direction (rightward in FIGS. 3 and 4) along which the left breast 21*a* moves away from the right breast 22*a* retained at the front needle bed FB. After the racking, the right breast 22*a* is knitted by one course, and, after the knitted loop of the end of the right sleeve front portion 13*a* close to the breast is transferred to that of the end of the right breast 22*a* close to the sleeve and is superposed with it, the right breast 22*a* is formed by one course while forming a one-knitted-loop increase at empty needles next to the end of the right breast 22*a* in the knitted loops of the front neckline 41 retained at the back needle bed BB.

As described above, when the operations of racking the back needle bed BB by the number of pitches in proportion to the number of increases (two pitches for a one-knitted-loop increase) and knitting the right breast 22*a* for the predetermined courses while forming increases corresponding to the number of pitches of the racking at the end, close to the right breast 22*a*, of the front neckline 41 retained at the back needle bed BB are repeated by the predetermined number of times, the right sleeve front portion 13*a* and the right breast 22*a* can be joined together while providing the front neckline 41 with an increased number of knitted loops.

In Step 12, the right breast 22*a* is knitted for eight courses, each with the same number of knitted loops, and also the right sleeve front portion 13*a* is completely joined with the right breast 22*a*.

At this moment, an increase is formed at the empty needle of the back needle bed BB, close to the end of the neckline for each knitting course of the right breast 22*a*, the knitted loops of the periphery of the front neckline 41 are sequentially formed in an inoperative state along line f-y, and the number of knitted loops of the front neckline 41 is increased by 4 (wales) during Step 12.

After the knitting of Step 12, transferring the left breast 21*a* and the front neckline 41 (line Y-F-G-g-f-y), all retained at the back needle bed BB, to the front needle bed FB brings about Step 13. Thus, the front neckline 41 is formed along line f-y and also the right sleeve front portion 13*a* is completely joined with the right breast 22*a*.

Step 14 is a process in which the back 2*b* is knitted from line Z-z to line J-j while being joined with the left- and right-sleeve back portions 3*b* and 13*b*.

In Step 14, after only the back 2*b* is knitted by two courses, all knitted loops of the back 2*b* and the left-sleeve back portion 3*b* retained at the back needle bed BB are transferred to the empty needles of the front needle bed FB.

Then, after racking the back needle bed BB by two pitches toward the left-sleeve back portion 3*b* (rightward in FIG. 4), all knitted loops of the back 2*b* retained at the front needle bed FB are returned to the back needle bed BB. With this operation, the knitted loops of the ends of the back 2*b* and the right-sleeve back portion 13*b* are superposed and joined together.

Subsequently, racking of the back needle bed BB is performed rightward in the FIG. 4 by two additional pitches, and the knitted loop of the end, close to the torso, of the left-sleeve back portion 3*b* retained at the front needle bed FB is transferred to the back needle bed BB. With this operation, the knitted loops of the ends of the back 2*b* and the left-sleeve back portion 3*b* are superposed and joined together.

Then, in a state in which the knitted loops of the left-sleeve back portion 3*b* are retained at the front needle bed FB, the same operations as the above-described ones composed of knitting the back 2*b*, the racking operation of the back needle bed BB, loop transfer of the knitted loop of the back 2*b*, and loop transfer of the knitted loop of the end, close to the torso, of the left-sleeve back portion 3*b* to the back needle bed BB are repeated. By performing a series of these operations for a predetermined number of times, the left-sleeve back portion 3*b* and the back 2*b* are joined together.

Also, in Step 14, subsequently, all knitted loops of the left-sleeve back portion 3*b* retained at the empty needles of the front needle bed FB are returned to the back needle bed BB, and, after only the back 2*b* is knitted by two courses, all knitted loops of the back 2*b* and the right-sleeve back portion 13*b* retained at the back needle bed BB are transferred to the empty needles of the front needle bed FB.

Then, after racking the back needle bed BB by two pitches toward the right-sleeve back portion 13*b* (leftward in FIG. 4), all knitted loops of the back 2*b* retained at the front needle bed FB are returned to the back needle bed BB. With this operation, the knitted loops of the ends of the back 2*b* and the left-sleeve back portion 3*b* are superposed and joined together.

Subsequently, racking the back needle bed BB is performed leftward in FIG. 4 by two additional pitches, and the knitted loop of the end, close to the torso, of the right-sleeve back portion 13*b* retained at the front needle bed FB is transferred to the back needle bed BB. With this operation, the knitted loops of the ends of the back 2*b* and the right-sleeve back portion 13*b* are superposed and joined together.

Then, in a state in which the knitted loops of the right-sleeve back portion 13*b* are retained at the front needle bed FB, the same operations as described above, composed of the knitting of the back 2*b*, the racking operation of the back needle bed BB, loop transfer of the knitted loops of the back 2*b*, and loop transfer of the knitted loop of the end, close to the torso, of the right-sleeve back portion 13*b* to the back needle bed BB are repeated. By repeating a series of these operations for a predetermined number of times, the right-sleeve back portion 13*b* and the back 2*b* are completely joined together.

Then, while performing a passing operation of the operations repeating rightward racking of the back needle bed BB, loop transfer of the knitted loop of the right end of the back needle bed BB to the front FB, and also loop transfer of the knitted loop of the left end of the front needle bed FB to the back needle beds FB and BB, the knitted loops, hooked at the needles of the front and back needle beds FB and BB, of the ends of the left breast 21*a* and the back 2*b*, respectively, close to the armhole are brought into a state of facing each other as shown in Step 15.

In Steps 16 to 25, while performing knitting for forming a shoulder line of the torso to the armhole, knitting of the front neckline 41 for increasing its knitted width from line y-f-g-G-F-Y of the same is performed so as to complete formation of the neckline 4.

Step 16 shows a state in which the partial knitting is applied to the left breast 21*a* from line D-Y to line D-E of the same in order to form the shoulder line portion of the left breast 21*a* to the armhole.

In Step 16, first of all, the knitted loops of the right breast 22*a* and the front neckline 41 (line y-f-g-G-F-Y) retained at the front needle bed FB are transferred to the empty needles of the back needle bed BB.

Then, racking of the back needle bed BB is performed by two pitches leftward in FIG. 4. After the racking, while knitting the left breast 21*a* by two courses by partial knitting, a one-knitted-loop increase is formed at the needles next to the end of the left breast 21*a* in the knitted loops of the front neckline 41 retained at the back needle bed BB. In addition, a passing operation of transferring the knitted loop of the end, close to the armhole, of the left breast 21*a* retained at the front needle bed FB to the empty needle of the back needle bed BB sequentially from the outside is performed.

As described above, when the operations of racking the back needle bed BB by the number of pitches in proportion to the number of knitted loop increases (two pitches for a one-knitted-loop increase) and knitting the left breast 21*a* for performing the predetermined courses while forming increases corresponding to the number of pitches of the racking at the end, close to the left breast 21*a*, of the front neckline 41 retained at the back needle bed BB are repeated a predetermined number of times, the shoulder line portion to the armhole can be formed by applying partial knitting to the left breast 21*a* while providing the front neckline 41 with knitted loop increases.

In Step 16, while knitting a portion of the left breast 21*a* close to the arm hole by partial knitting so as to knit the left breast 21*a* for eight courses, the knitted loops of the periphery of the front neckline 41 are sequentially made in an inoperative state along line Y-E, and the number of knitted loops of the front neckline 41 is increased by an additional four (wales).

After the knitting operation in Step 16, while performing a passing operation of repeating the operations of transferring the knitted loops of the right breast 22*a* and the front neckline 41 (line y-f-g-G-F-Y-E) retained at the empty needles of the back needle bed BB to the front needle bed FB, rightward racking of the back needle bed BB, loop transfer of the knitted loop of the right end of the back needle bed BB to the front needle bed FB, and loop transfer of the knitted loop of the left end of the front needle bed FB to the back needle bed BB, the knitted loops, hooked at the needles of the front and back needle beds FB and BB, of the ends of the left breast 21*a* and the back 2*b*, respectively, close to the armhole are brought into a state of facing each other as shown in Step 17.

According to Step 17, the front neckline 41 is formed along line Y-E as shown in FIG. 2.

Step 18 is a process in which the back 2*b* is knitted from line J-j to line K-k while knitting both ends by partial knitting. When the back 2*b* is knitted, it is knitted by partial knitting by applying a tucking process or the like to the knitted loops of both ends so as to sequentially bring them into an inoperative state.

With completion of knitting in Step 18, since the ends, close to the armhole, of the left breast 21*a* hooked at the needles of the front needle bed FB and the back 2*b* hooked at the needles of the back needle bed BB face each other, the left breast 21*a* is joined with the back 2*b* by casting-off as shown in Step 19. The portions joined by casting-off are detached from the needles of the front and back needle beds.

Then, in order to transfer all knitted loops of the right breast 22*a* to the front needle bed FB, a passing operation of repeating the operation of loop transfer of the knitted loop of the right end of the front needle bed FB to the back needle bed BB, and loop transfer of the knitted loop of the left end of the back needle bed BB to the front needle bed FB while racking the back needle bed BB leftward is performed so as to bring about a state of Step 20.

Step 21 is a process in which, in order to form a shoulder line portion to the armhole at the right breast 22*a* from the state of Step 20, partial knitting is applied to the right breast 22*a* from line d-y to line d-e.

In Step 21, first of all, all knitted loops of the front neckline 41 (line y-f-g-G-F-Y-E) retained at the front needle bed FB are transferred to the empty needles of the back needle bed BB.

Then, racking of the back needle bed BB is performed by two pitches rightward in FIG. 4. After the racking, a passing operation is performed by forming increases at the empty needles next to the end the right breast 22*a* in the knitted loops of the front neckline 41 retained at the back needle bed BB while knitting the right breast 22*a* by two courses by partial knitting, and transferring the knitted loop end of the right breast 22*a* close to the armhole to the empty needle of the back needle bed BB sequentially from the outside.

As described above, when the operations of racking the back needle bed BB by the number of pitches in proportion to the number of increases (two pitches for a one-knitted-loop increase) and knitting the right breast 22*a* for the predetermined courses while forming increases corresponding to the number of pitches of the racking at the end, close to the right breast 22*a*, of the front neckline 41 retained at the back needle bed BB are repeated a predetermined number of times, the right breast 22*a* can be narrowed and the shoulder line portion to the armhole can be formed while providing the front neckline 41 with increases.

In Step 21, while knitting a portion of the right breast 22*a* close to the arm hole by partial knitting so as to knit the right breast 22*a* for eight courses, the knitted loops of the periphery of the front neckline 41 are sequentially brought in an inoperative state along line y-e, and the number of knitted loops of the front neckline 41 is increased by an additional four (wales).

After the knitting operation in Step 21, while performing a passing operation of repeating the operations of loop transfer of the knitted loops of the front neckline 41 (line e-y-f-g-G-F-Y-E) retained at the empty needles of the back needle bed BB to the front needle bed FB, performing leftward racking of the back needle bed BB, loop transfer of the knitted loop of the left end of the back needle bed BB to the front needle bed FB, and also loop transfer of the knitted loop of the right end of the front needle bed FB to the back needle bed BB, the knitted loops, hooked at the needles of the front and back needle beds FB and BB of the ends of the right breast 22*a* and the back 2*b*, respectively, close to the armhole are brought into a state of facing each other as shown in Step 22.

According to Step 22, the front neckline 41 is formed along line y-e as shown in FIG. 2.

Then, as shown in Step 23, the right breast 22*a* is joined with the back 2*b* by casting-off. The portions joined by casting-off are detached from the needles, and only the front neckline 41 and a back neck line 42 in Step 24 are hooked at the needles of the front and back needle beds.

Further, in order to form the collar 5 along the neckline 4, a passing operation of repeating the operation of rightward racking of the back needle bed BB and loop transfer is performed so as to bring the centers of the front neckline 41 of the breast 2*a* and of the back neckline 42 of the back 2*b* in coincidence with each other, and thus a state of Step 25 is brought about.

Even when the knitted width of the front neckline 41 is increased as described above, and as a result, a large difference in knitted widths between the front and back necklines 41 and 42 occurs, by balancing the number of stitches of knitting fabric retained at the front and back needle beds by feeding the knitted loops of the side end of the front neckline 41 of the breast 2*a* to the back needle bed BB, the knitted loops at the boundary can maintain a mutually close state without detaching from each other. As a result, occurrence of broken threads can be prevented and a cylindrical body can be knitted.

Then, the collar 5 is knitted in the state of Step 25, and knitting of the sweater 1 is completed.

As described above, since only the front neckline 41 of the breast 2*a* is provided with increases when the front neckline 41 is formed, the knitted width of the front neckline 41 is greater than that of the back neckline 42, whereby a difference in the front and back knitted widths can be generated.

Furthermore, even when the knitted width of the front neckline 41 is greater than that of the back neckline 42, after one of the shoulders is joined by casting off, the other shoulder is aligned by passing knitting fabric retained at the front and back needle beds and is joined by casting off, whereby the degree of freedom of the number of increases of the front neckline 41 can be increased without increasing the length of the back neckline 42. As a result, an excellently fashionable design can be achieved.

In particular, according to the present embodiment, since the shoulder line portions to the armholes are formed on the shoulder portions of the breast 2*a* and the back 2*b*, formation of the shoulder line portions to the armholes allows the knitted loops of the front neckline 41 to be increased by a desired number while the lengths of the armholes 23 are kept constant.

In addition, by feeding the knitted loops of both sides of the front neckline 41 to the back needle bed BB, the knitted widths of the front and back needle beds are aligned when the collar 5 is knitted, whereby the collar portion can be cylindrically knitted without any problem.

As described above, according to the present embodiment, the knitted sweater 1 has an excellently fashionable feature without causing the length of the back neckline 42 to become longer, with the neckline 4 having a front hanging shape. In addition, it is comfortable to wear since its wide bore neckline allows a wearer to easily pass his or her head therethrough.

Figure 6:
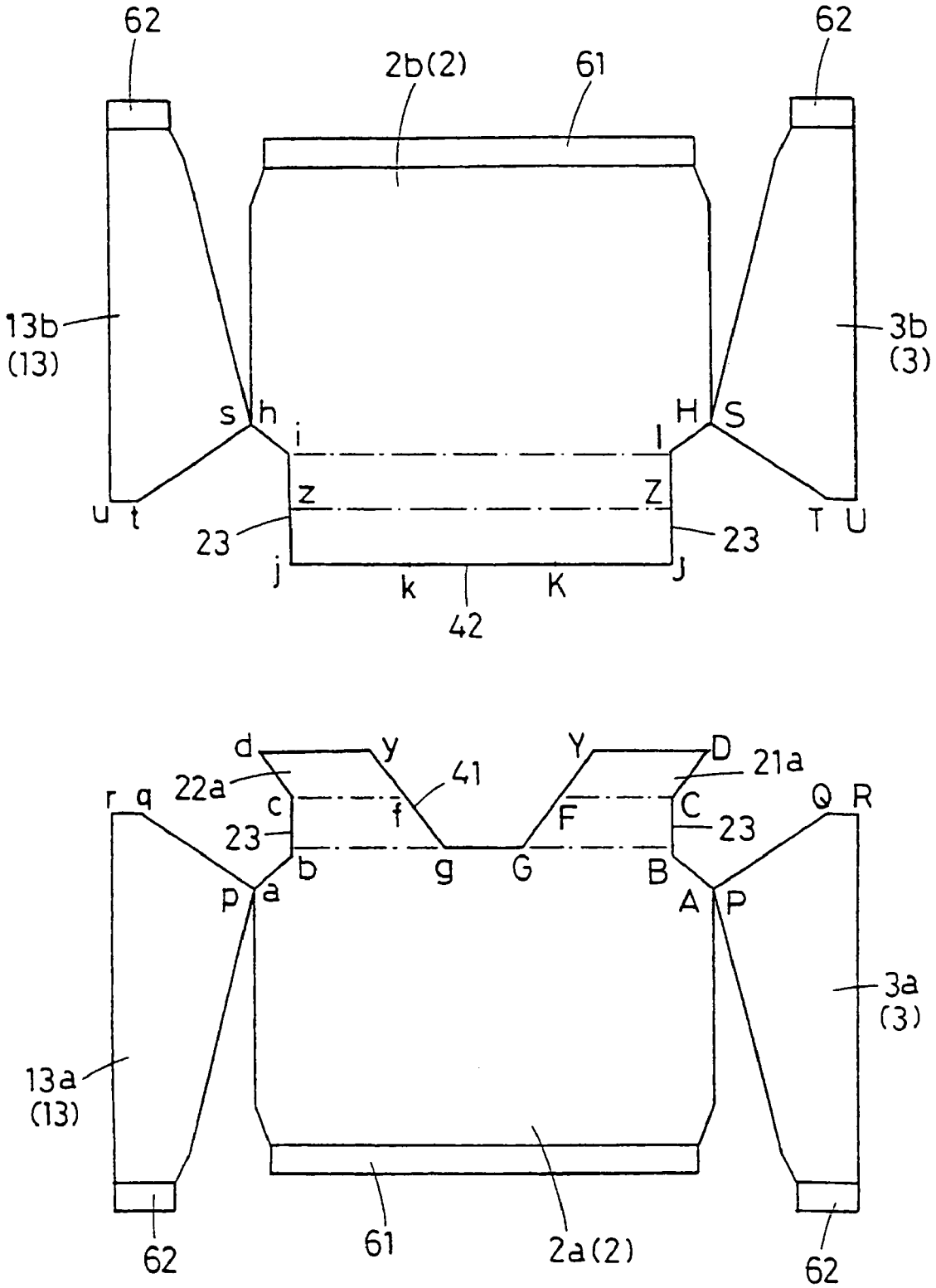
FIG. 6 illustrates a state in which all parts making up a sweater as a second embodiment are knitted by a flat knitting machine.
Figure 7:
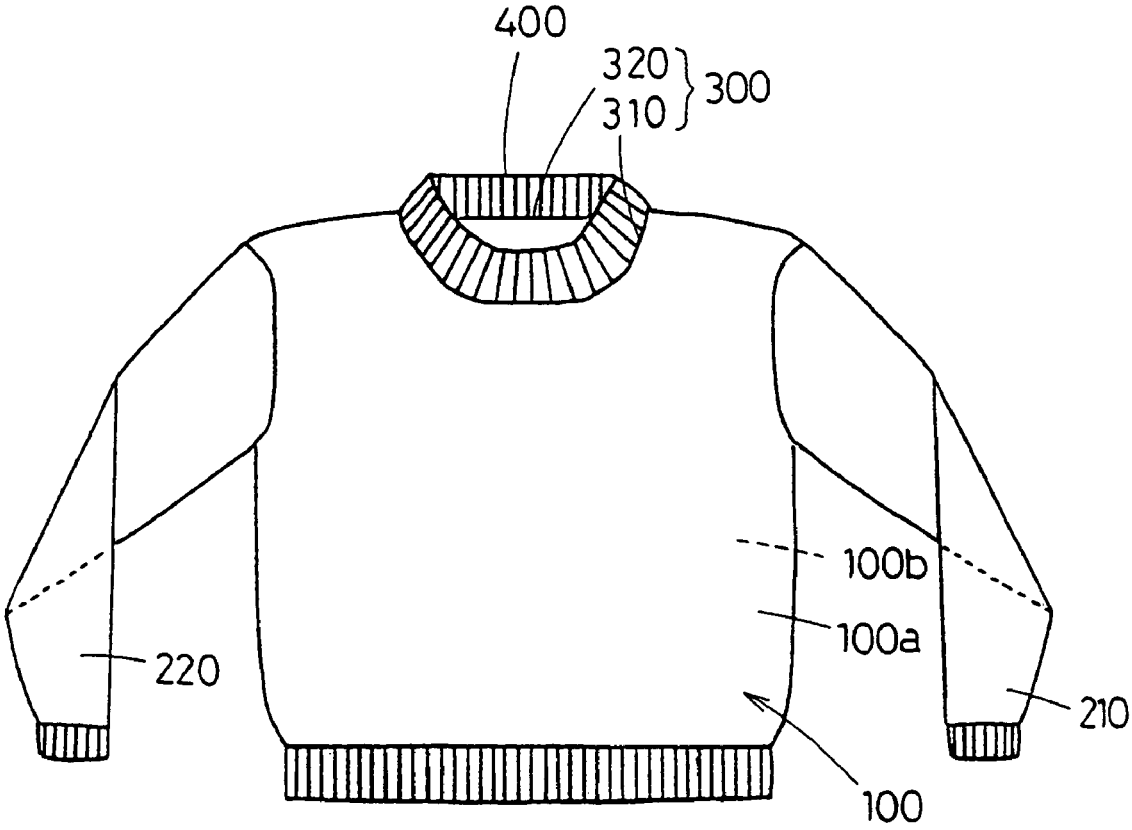
FIG. 7 illustrates a known round-necked set-in sweater.
Figure 8:
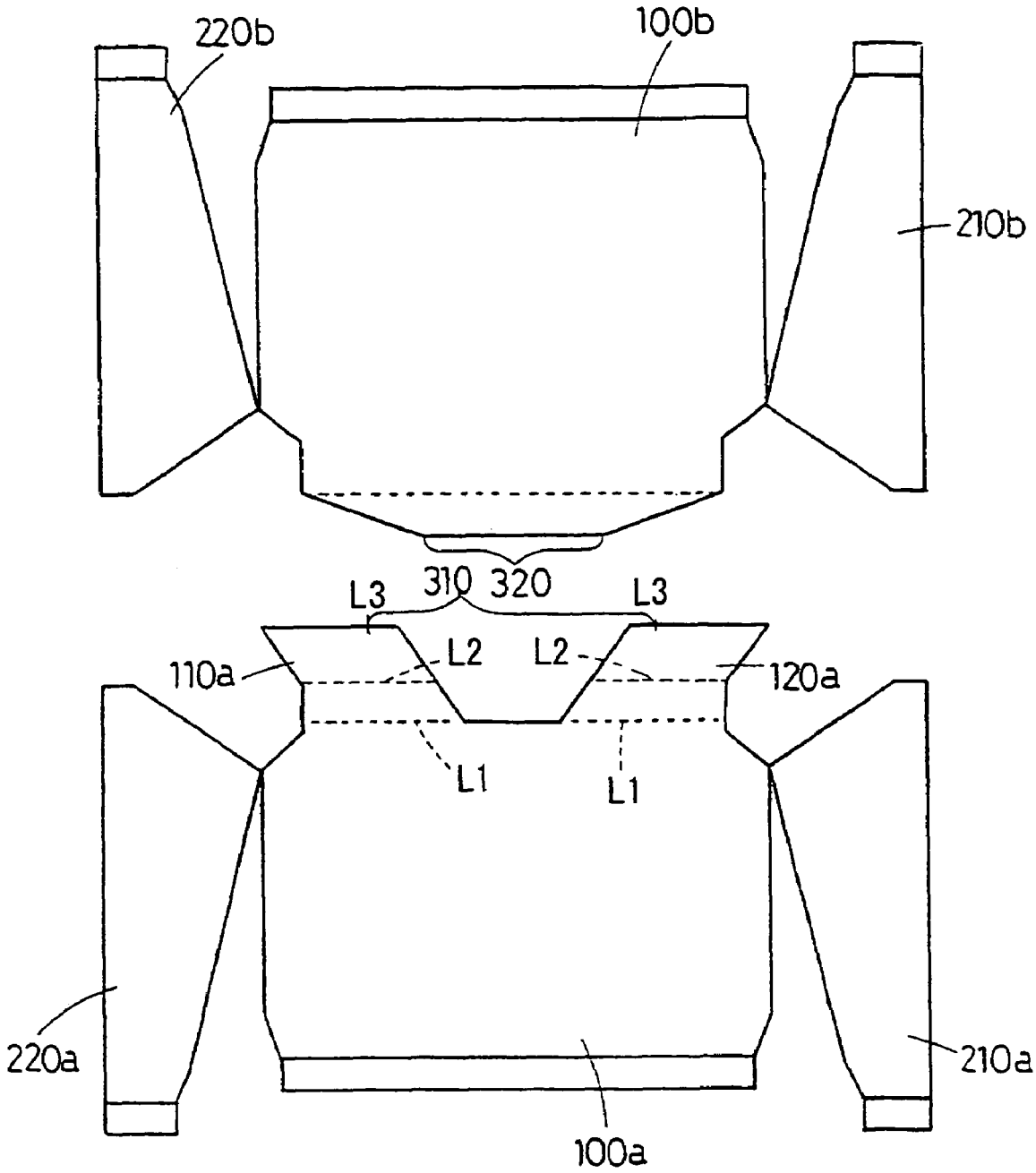
FIG. 8 illustrates a state in which all parts making up the known round-necked set-in sweater are knitted by a flat knitting machine.

Further, although the shoulder lines to the armholes are formed on the torso as shown in Steps 16 to 25 according to the first embodiment, the shoulder line portions to the armholes may not be knitted as illustrated in a paper pattern drawing shown in FIG. 6 according to a second embodiment (that is, corresponding to that in which the triangular parts of the breast 2*a* formed by line D-Y-E and line d-y-e, and the trapezoidal part of the back 2*b* formed by line j-k-K-J are excluded in FIG. 2).

Since the set-in sweater according to the second embodiment shown in FIG. 6 has the same shape and is knitted in the same manner as that up to Step 15 in the knitting step diagram shown in FIGS. 3 to 5, excluding the triangular portions of the breast 2*a* formed by line D-Y-E and by line d-y-e and the trapezoidal portion of the back 2*b* formed by line j-k-K-J according to the first embodiment shown in FIG. 2, its explanation will be omitted.

In the case of the second embodiment, in the knitting step diagram shown in FIGS. 3 to 5, after joining the shoulder line portions of the left breast 21*a* and the back 2*b* with each other by casting off in the state of Step 15, knitted fabric is passed so that the ends of the right breast 22*a* and the back 2*b* face each other, and the remaining shoulder portions are joined together by casting off.

Then, in order to form the collar 5 to the neckline 4, a passing operation of cylindrically knitting fabric is performed while repeating racking and loop transfer of the back needle bed BB so as to bring the centers of the front neckline 41 of the breast 2*a* and the back neckline 42 of the back 2*b* in coincidence with each other.

According to the present invention, as described in the foregoing first and second embodiments, after the breast to be knitted is left at the front needle bed FB and other knitted loops are transferred to the empty needles of the back needle bed BB when the front neckline 41 is formed, increased knitted loops are formed at the back needle bed BB while racking it, and also the breast is knitted, whereby the number of loop transfers of the knitted loops can be reduced as much as possible. As a result, knitting for forming increases of the front neckline 41 can be easily carried out while reducing damage on yarn as little as possible.

According to the present embodiments, although the collar 5 is knitted so as to provide a round neck, a collar having a desired design such as a stand collar can be knitted. Also, a collar having a U-necked neckline or a V-necked neckline can be formed.

Meanwhile, the present invention is applicable to a set-in type sweater having a design in which the joining portion of the breast and the back passes across the shoulder line and enters the back. Also, the present invention is not limited to a sweater, and is also applicable to a cardigan, a sleeveless sweater, a vest, and the like.

As described above, according to the present invention, by providing increases only to the front neckline of the breast when the front neckline is formed, the knitted width of the front neckline is greater than that of the back neckline, whereby a difference in the front and back knitted widths can be generated.

Further, when the front neckline is formed, after the breast to be knitted is left at the knitting needles, and the other knitted loops are transferred to the empty needles of the other needle bed, increases are formed at the other needle bed while performing racking when the front neckline is formed. Thus, the number of loop transfers of the knitted loops can be reduced as little as possible so as to reduce damage on yarn, and knitting for forming knitted loop increases of the front neckline can be easily carried out.

Furthermore, even when the knitted width of the front neckline is greater than that of the back neckline, after the joint of one of the shoulders is formed by casting off, the other shoulder is aligned by passing knitting fabric retained at the front and back needle beds and its joint is formed by casting off. Thus, the degree of freedom of the number of increases of the front neckline can be increased without increasing the length of the back neckline. As a result, an excellently fashionable design can be achieved.

Also, according to the present invention, since the shoulder line portions to the armholes can be formed on the shoulder portions of the breast and the back, formation of the shoulder line portions allows the knitted loops of the front neckline to be increased by a desired number while the lengths of the armholes are kept constant.

The invention claimed is:

1. A knitting method for knitwear in which a knitwear torso is knitted using a flat knitting machine comprising at least a pair of front and back needle beds extending in the left direction and the right direction and facing each other in the front direction and back direction, at least one of the front and back needle beds being capable of sideways racking, and being capable of loop transfer of knitted loops between the front and back needle beds, the knitting method comprising:

knitting the torso from the hem to the armpits;

after said knitting the torso from the hem to the armpits, knitting the torso from the armpits to the shoulder while knitting a breast portion by branching off the breast portion into a right breast portion and a left breast portion from a front neckline forming portion so as to form a neckline portion on the torso, said knitting of the torso from the armpits to the shoulder comprising:

a first process including:

a first sub-process including:

transferring all knitted loops excluding those of either the right breast portion or the left breast portion to a first needle bed having knitted loops of a back portion retained thereat;

racking the needle beds in the direction in which one of the breast portions at the first needle bed having the knitted loops of the back portion retained thereat moves away from the other of the breast portions retained at a second needle bed by a number of pitches in proportion to a number of knitted loops to be increased; and after knitting the breast portion retained at the second needle bed for a predetermined number of courses while an increased number of knitted loops of the front neckline at the first needle bed having the knitted loops of the back portion retained thereat are formed at an end close to the breast portion retained at the second needle bed so as to correspond to the number of racking pitches, transferring the knitted loops transferred to the first needle bed having the knitted loops of the back portion retained thereat to the second needle bed;

a second sub-process including:

transferring all knitted loops excluding those of the breast portion which is not subjected to knitting for these predetermined number of courses to the first needle bed having the knitted loops of the back portion retained thereat;

racking the needle beds in the direction where the breast portion at the first needle bed having the knitted loops of the back portion retained thereat moves away from the breast portion retained at the second needle bed by a number of pitches in proportion to a number of knitted loops to be increased; and, after knitting the breast portion retained at the second needle bed for a predetermined number of courses while increases of the front neckline at the first needle bed having the knitted loops of the back portion retained thereat are formed at its end close to the breast retained at the other needle bed so as to correspond to the number of pitches of racking, transferring the knitted loops transferred to the first needle bed having the knitted loops of the back portion retained thereat to the second needle bed; and a third sub-process process including knitting the back portion for a predetermined number of courses;

a second process including, after or halfway through said first process, arranging an end of the back portion knitted in the first process and an end, close to an armhole, of either the right breast portion or the left breast portion knitted in the first process so as to face each other by a passing operation of knitted loops, the passing operation comprising racking of the needle beds and loop transfer to the front and back needle beds, and joining the back portion and either the right breast portion or the left breast portion together by shoulder casting off; and a third process including, after said first process and the second process, arranging an end of the back portion which is not subjected to shoulder casting off, and an end, close to the armhole, of either the left breast portion or the right breast portion which is not subjected to shoulder casting off so as to facing each other by the passing operation of knitted loops, the passing operation comprising racking of the needle beds and loop transfer to the front and back needle beds, and joining the back portion and either the left breast portion and the right breast portion together by shoulder casting off.

2. The knitting method of claim 1, wherein said first process further includes initial processing increases of the front neckline while knitting the right breast portion and the left breast portion for the predetermined number of courses, each with the same number of knitted loops, and knitting the back portion for the predetermined number of courses; and after said knitting of the breast portion and the back portion by said initial precessing increases of the front neckline, secondary processing increases of the front neckline while knitting the right breast portion and the left breast portion for the predetermined number of courses with their ends close to the armholes being processed by partial knitting, and knitting the back portion for the predetermined number of courses, wherein knitting during said second process and said third process is performed after one of the right breast portion and the left breast portion is knitted by said secondary precessing increases of the front neckline.

* * * * *